US008225634B2

(12) United States Patent
Giacomin et al.

(10) Patent No.: US 8,225,634 B2
(45) Date of Patent: Jul. 24, 2012

(54) DEVICE FOR POSITIONING AND HOLDING AN EMERGENCY KEY

(75) Inventors: Fabrice Giacomin, Creteil Cedex (FR); Louis Canard, Creteil Cedex (FR)

(73) Assignee: Valeo Securite Habitacle, Créteil Cedex (FR)

( * ) Notice: Subject to any disclaimer, the term of this patent is extended or adjusted under 35 U.S.C. 154(b) by 0 days.

(21) Appl. No.: 12/097,957

(22) PCT Filed: Dec. 20, 2006

(86) PCT No.: PCT/FR2006/002808

§ 371 (c)(1),
(2), (4) Date: Jun. 18, 2008

(87) PCT Pub. No.: WO2007/077332

PCT Pub. Date: Jul. 12, 2007

(65) Prior Publication Data

US 2009/0000343 A1 Jan. 1, 2009

(30) Foreign Application Priority Data

Dec. 20, 2005 (FR) ..... 05 12995

(51) Int. Cl.
*A47G 29/10* (2006.01)

(52) U.S. Cl. ..... 70/456 R; 109/70; 206/1.5; 206/37.1; 220/820; 292/DIG. 37

(58) Field of Classification Search ..... 70/456 R, 70/459; 109/70; 206/38.1, 37.1–37.5, 1.5; 220/281, 820, 821; 292/DIG. 37
See application file for complete search history.

(56) References Cited

U.S. PATENT DOCUMENTS

| | | | | | |
|---|---|---|---|---|---|
| 976,165 | A | * | 11/1910 | Gray | 206/1.5 |
| 1,009,238 | A | * | 11/1911 | Goffin | 217/56 |
| 1,386,738 | A | * | 8/1921 | Sonnenberg | 49/257 |
| 1,901,551 | A | * | 3/1933 | Cipullo | 220/302 |
| 1,997,043 | A | * | 4/1935 | Clark | 206/246 |
| 2,025,410 | A | * | 12/1935 | Bonn | 206/1.5 |
| 2,337,894 | A | * | 12/1943 | Jacobi | 292/227 |
| 2,420,125 | A | * | 5/1947 | Crist | 248/551 |
| 2,449,722 | A | * | 9/1948 | Saathoff | 232/4 R |
| 4,070,074 | A | * | 1/1978 | Rohme | 312/245 |
| 4,888,970 | A | * | 12/1989 | Kinzler et al. | 70/456 R |
| 4,891,961 | A | * | 1/1990 | Tsamas | 70/456 R |
| 4,939,917 | A | | 7/1990 | Cartwright | |
| 4,951,489 | A | | 8/1990 | Proch | |
| 5,038,932 | A | * | 8/1991 | Sheu | 206/387.1 |
| 5,209,089 | A | * | 5/1993 | Nelson | 70/456 R |

(Continued)

OTHER PUBLICATIONS

International Search Report from PCT/FR2006/002808 dated May 21, 2007 with English Translation (6 pages).

*Primary Examiner* — Lloyd Gall
(74) *Attorney, Agent, or Firm* — Osha Liang LLP

(57) ABSTRACT

A device for positioning and holding a key in a container including a cover and a casing. The device includes an opening/closing mechanism enabling the cover and the casing to be mobile in relation to each other at least in rotation, about a rotational axis, between an open position providing access to a housing of the container and a closed position. The device also includes a locking/unlocking mechanism of the cover and the casing, at least in a closed position, comprising a locking/unlocking control device which is mobile in translation following a translation axis.

9 Claims, 5 Drawing Sheets

U.S. PATENT DOCUMENTS 5,261,122 A 11/1993 Otsuki et al.
5,732,820 A * 3/1998 Tsai ..... 206/369
6,099,047 A * 8/2000 Reiff et al. ..... 292/4
6,341,693 B2 * 1/2002 Konno et al. ..... 206/449
6,382,410 B1 * 5/2002 Magid et al. ..... 206/38.1
6,705,141 B1 * 3/2004 Jacob et al. ..... 70/408
6,789,677 B2 * 9/2004 Maietta ..... 206/536
7,377,145 B2 * 5/2008 Chen ..... 70/456 R
7,404,363 B2 * 7/2008 Dunstan ..... 109/70
2002/0056652 A1 5/2002 Kawamura et al.
2003/0177798 A1 9/2003 Chodosh
2003/0226772 A1 * 12/2003 Smith et al. ..... 206/37.1

* cited by examiner

DEVICE FOR POSITIONING AND HOLDING AN EMERGENCY KEY

FIELD OF THE INVENTION

The invention relates to a device for positioning and holding an emergency key.

It relates, in particular but not exclusively, to the positioning and holding of an emergency key in a system for starting a vehicle, it being understood that for this type of application the container has to make it possible to ensure easy and ergonomic positioning of the key in its housing, and removal of the key from its housing, inside the container. Moreover, it is necessary to guarantee good security of the closure of the container.

BACKGROUND OF THE INVENTION

Many solutions have already been proposed for concealing an emergency key within a car. Thus, in particular, magnetized boxes exist which have a cover which may be placed, for example, inside the wheel arch. This type of box is frequently used in the United States of America. However, these boxes do not allow easy and ergonomic operation to simplify the task of the operator. Furthermore, they are very difficult to incorporate in the passenger compartment of a vehicle.

Integral supports also exist, allowing the emergency key to be held in a cavity provided to this end. This solution does not allow the key to be sufficiently protected.

Currently, containers for emergency keys have an additional function. More specifically, these containers are used as an interface between the emergency key which comprises a transponder and the security system of the vehicle comprising a reader capable of receiving the container and reading the data from the transponder. It is, therefore, necessary to have a container which ensures the functions of this interface and which allows a specific positioning of the emergency key in the container so that when said emergency key is inserted into the reader of the vehicle, the reading of the transponder may be carried out.

Moreover, current containers are not ergonomic, for example they do not permit opening with one hand. More specifically, it is important to be able to open and close the container with one hand to be able to hold the key in the other hand and thus to position and remove the key easily from its container.

SUMMARY OF THE INVENTION

The object of the present invention is to remedy these major drawbacks by proposing a device which is particularly well adapted to improve the level of protection of the key, the ergonomics and the ease of use which are essential factors today so that vehicle equipment is acceptable to users. This device also permits a specific positioning of the key in the container so that the transponder of the key may interact in an optimal manner with the reader of the security system of the vehicle.

To this end, the invention proposes a device for positioning and holding a key, said device using a container comprising at least two parts which are mobile relative to one another and comprising

- opening/closing means allowing the two parts to be mobile in relation to one another, at least in rotation, about a rotational axis, between an open position providing access to a housing of the container and a closed position in addition to

- means for locking/unlocking the two parts at least in a closed position comprising a locking/unlocking control member which is mobile in translation along a translation axis.

The translation axis and the rotational axis may be perpendicular or parallel to one another.

In the case where the two axes are perpendicular, one of the parts comprises a joint link having two oblong parallel recesses allowing a locking/unlocking path in translation whilst the other part comprises means for articulation such as journals which engage in said recesses. The two parts comprise, moreover, interlocking means with axes parallel to the translation axis which cooperate with one another at the end of the locking path to prevent any relative rotation of the two parts in the locked position.

In contrast, the two parts are configured to pivot relative to one another at the end of the unlocking path. Locking/unlocking control means are in this case formed by the parts themselves.

In a complementary manner, the locking/unlocking means may moreover comprise guide means with slide rails provided on said parts permitting a relative movement in axial translation of the two parts.

In the case where the two axes are parallel, the two parts are rotatably mounted relative to one another about an axis which is fixed relative to the two parts. In this case, the locking means may comprise a control member which is mobile in translation along an axis parallel to the rotational axis and even coaxial therewith.

The following characteristics may be incorporated in the device described above:

- the rotational axis and the translation axis may be merged.
- the locking/unlocking means may comprise a button being able to be moved by an operator in translation along an axis Y Y' and having two principal positions, the first position, pushed-in, making it possible to release the rotational movement and the second position, which is not pushed-in, holding the parts in their closed and locked position.
- the locking/unlocking means may comprise a button slidably mounted in a cavity of the cover between a pushed-in position and a raised position, in addition to locking means actuated by the button which act on the rotatable mounting of the cover on the body so as to prevent the rotation of the cover in the raised position and to allow rotation in the pushed-in position.
- the locking/unlocking means may comprise, moreover, an elastic element tending to bring the button back into the locked position.
- the elastic element may be a spring operating in compression.
- means may be provided to allow the return of the button only when the parts are in the closed position.
- the opening/closing means may comprise a restoring spring tending to bring the parts back into the closed position.
- the opening/closing means may comprise a second elastic element opening the cover automatically as soon as the unlocking means are actuated.
- the second elastic element opening the cover automatically as soon as the unlocking means are actuated may be a spring operating in torsion and being prestressed in the closed position.
- the slots may each comprise a notch in which a protuberance provided on each elastic tab engages when the button is in the raised position.

the elastic element and the second elastic element may be combined in a single spring operating in compression and in torsion.

the cover may comprise an opening in order to allow the key to be passed through to allow the passage of the bow of the key.

the container may comprise an opening allowing the passage of the bow of the key.

the container may comprise on one part visible to the operator a surface for carrying information such as a logo.

the information carrier may be placed on the locking/unlocking control member which is mobile in translation.

As a result of the arrangements described above, the process of inserting the key comprises in principle the steps consisting in:

a) unlocking a part (known as mobile) relative to the other part (known as fixed)
b) opening the mobile part
c) inserting the key into the fixed part
d) closing the mobile part
e) locking the mobile part The process of removal, for taking out the key from the container, comprises simultaneously the steps consisting in:

a) unlocking the mobile part
b) opening the mobile part
c) removing the key from the fixed part
d) closing the mobile part
e) locking the mobile part

BRIEF DESCRIPTION OF THE DRAWINGS

Embodiments of the invention are described hereinafter by way of non-limiting example, by referring to the accompanying drawings, in which.

DETAILED DESCRIPTION

Figure 1A:
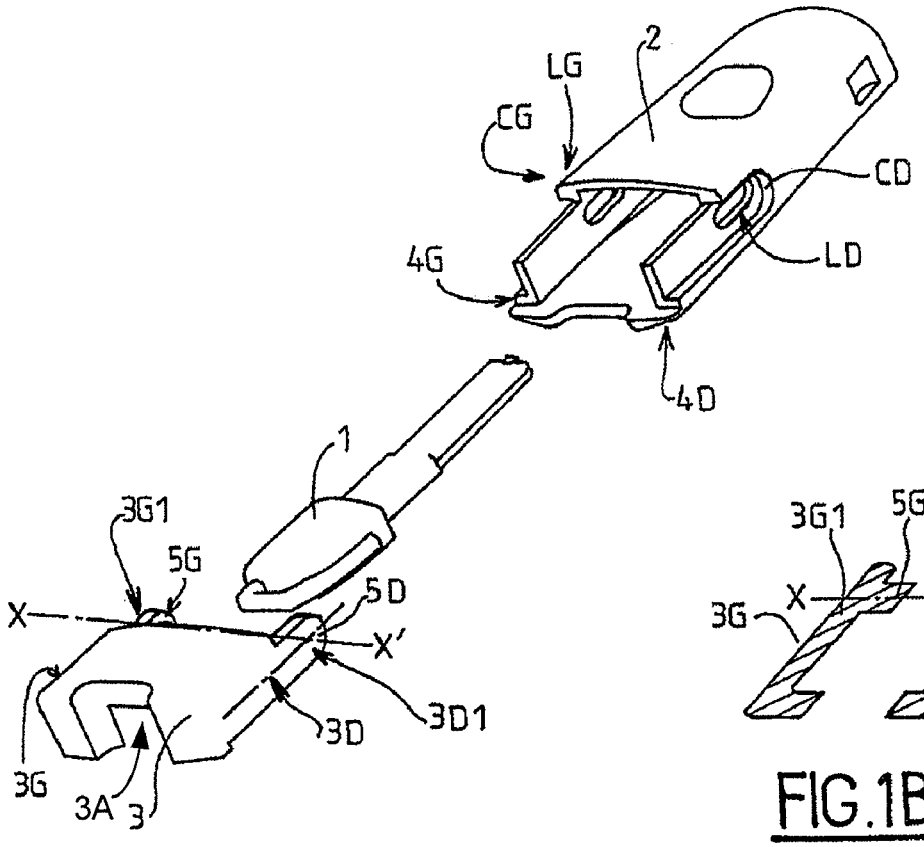
FIG. 1A shows schematically in an exploded perspective view a container according to a preferred arrangement of the invention.
Figure 1B:
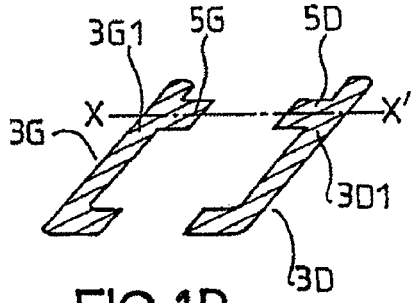
FIG. 1 is a partial longitudinal section of the cover of the container shown in FIG. 1A.

In the example shown in FIGS. 1A and 1B the container comprises a housing 2 having the general shape of a case comprising a tubular body (first part) closed on one side by a base and having on the other side a opening sealable by a cover 3 (second part) in order to be able to position a key 1.

In the region of the opening, the lateral faces of the body are extended by two lateral parallel slide rails 4D, 4G joined to one another by the extension of one face of the body. Said slide rails comprise a lower part acting as a guide. In the region of their connection with these slide rails 4D, 4G, the lateral faces of the body comprise two axially re-entrant cavities CD, CG into which two respective oblong parallel apertures LD, LG open, oriented according to the longitudinal axis of the body.

The cover 3 has a U-shaped transverse section of which the lateral segments 3D and 3G are intended to be engaged on the lateral sides of the slide rails so as to ensure an axial guiding of the cover relative to the body.

The cover further comprises in the region of its front end a return at right angles intended to ensure with its upper face the seal of the body in the closed position and in the region of its rear part two lateral arms 3D1, 3G1 which extend axially to form a joint link provided with two respective coaxial journals 5D, 5G, with the axis XX', intended to be engaged in the apertures of the body.

The cover also comprises in the region of its front end an aperture 3A making it possible to verify the presence of the key without having to open the container.

These two lateral arms are shaped so as to be able to be engaged in the two re-entrant cavities of the body to ensure locking in rotation of the body and of the cover at the end of the locking path.

The use of the container described above is relatively simple. Starting from an empty closed and locked container, in order to insert the key it suffices to displace the cover 3 longitudinally, removing the cover from the casing 2 perpendicularly to the axis XX'. The journals 5G and 5D are thus displaced in the apertures LD and LG to be brought into abutment on the front part of the apertures. In this position, the cover is free to turn about the axis XX' at least sufficiently to allow the passage of the key. More specifically, only in this position is the lower slide rail in contact with the lateral arms 3D1, 3G1 of the cover 3. The shape of the end of these lateral arms is rounded to allow the rotation of the cover. It suffices, therefore, after having inserted the key, to close the cover and to push said cover in the direction of the casing to lock the closure of the assembly.

This positioning and arranging device, in addition to the mounting in said device, makes it possible to guarantee the positioning of the key in the container such that the transponder of the key is positioned optimally in the reader when the container which incorporates said transponder is arranged in the reader of the security system of the vehicle. This reader therefore verifies the data of the transponder to authorize or not, for example, the start up of the vehicle.

To remove the key from the container while it is positioned in the closed and locked container, it suffices to carry out the same operations but by removing the key instead of inserting it.

Figure 2:
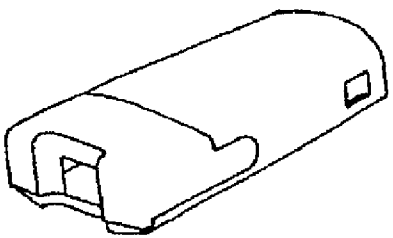
FIGS. 2 to 8 are schematic perspective views illustrating the sequences for positioning and removing a key from the container according to the preferred solution of FIG. 1.
Figure 3:
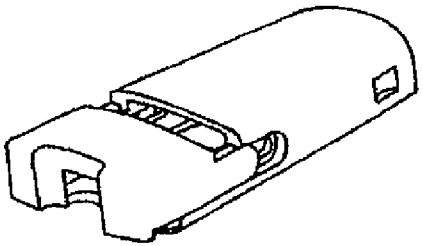
Figure 4:
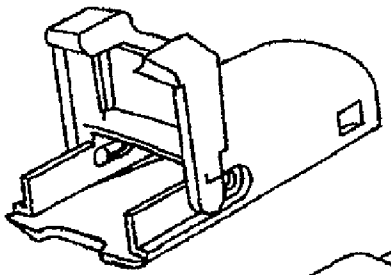
Figure 5:
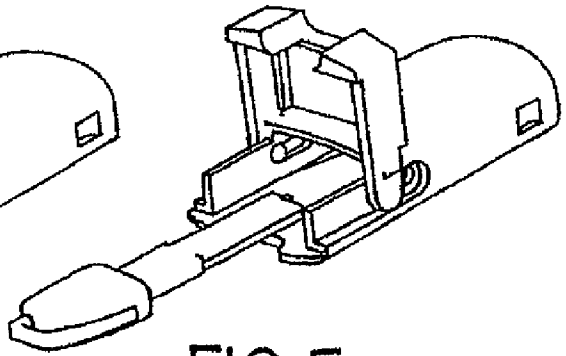
Figure 6:
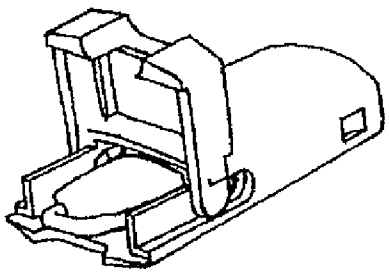
Figure 7:
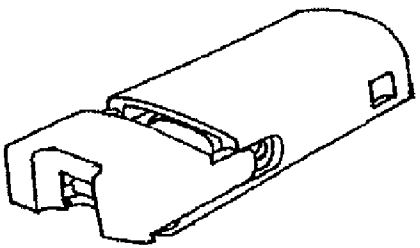
Figure 8:
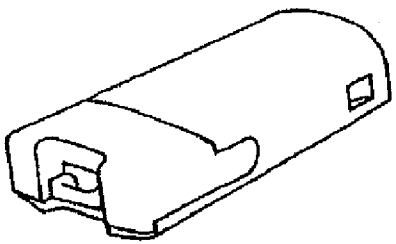

The steps of the process of positioning and removing the key from the container are shown in the series of FIGS. 2 to 8. FIG. 2 shows the empty container and the mobile part in the closed and locked position. FIG. 3 shows the empty container and the mobile part in the closed and unlocked position. FIG. 4 shows the empty container and the mobile part in the open position. FIG. 5 shows the introduction of the key. FIG. 6 shows the key in position in the container, the mobile part being in the open position. FIG. 7 shows the container containing the key and the mobile part in the closed and unlocked position. FIG. 8 shows the container containing the key and the mobile part in the closed and locked position.

Figure 9A:
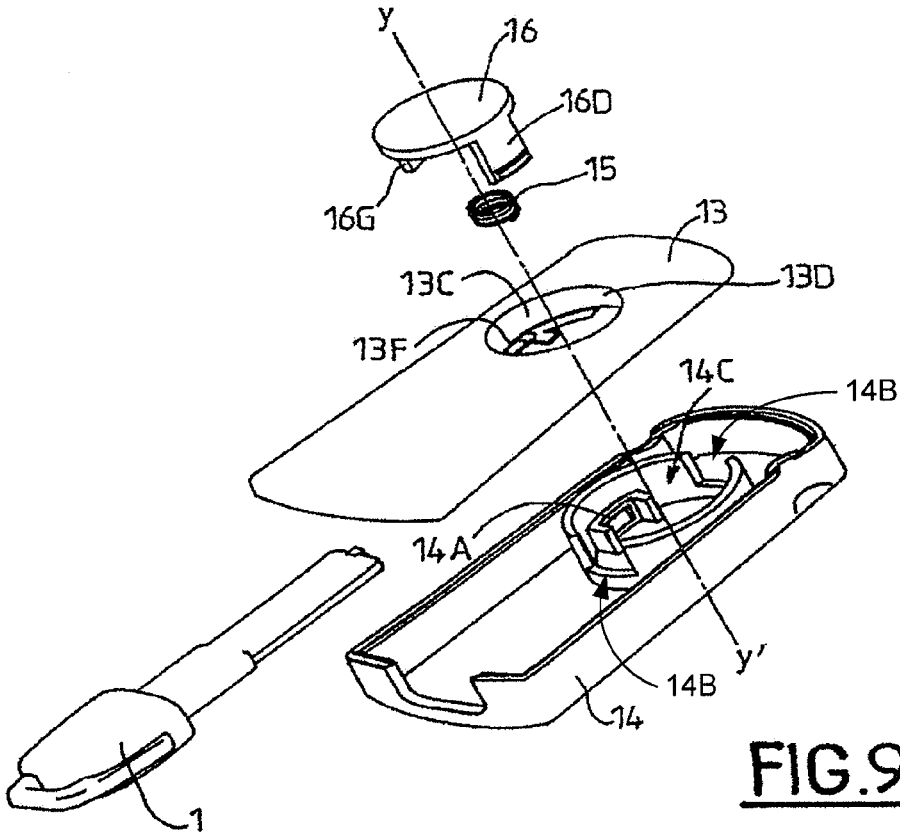
FIG. 9A is an exploded perspective view of a further preferred solution according to the invention.
Figure 9B:
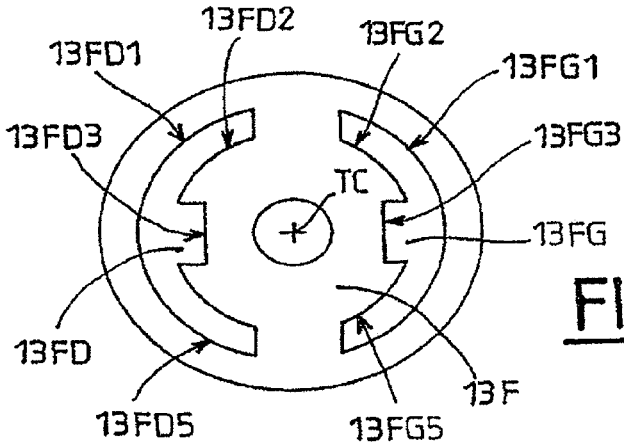
FIG. 9B is a partial view of the base 13F of the circular sleeve 13D of the cover 13 showing the shape of the recesses 13FD and 13FG.
Figure 16:
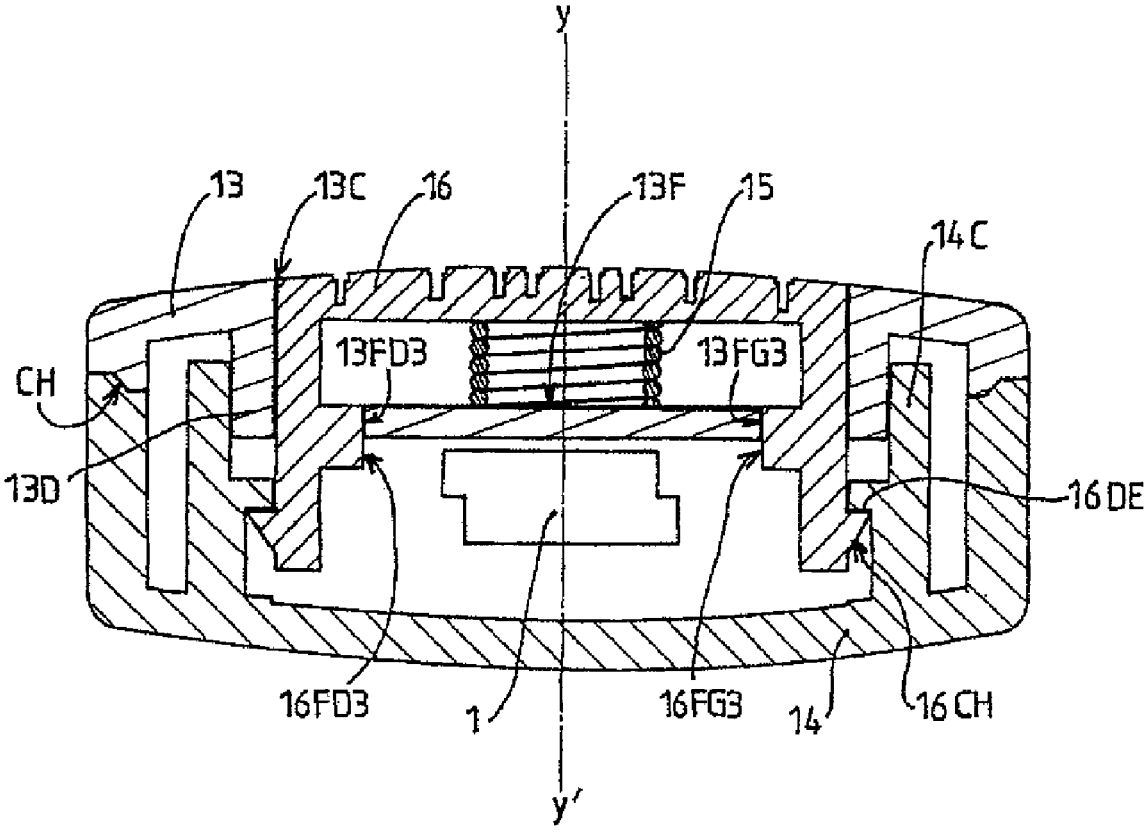
FIG. 16 shows a section of the assembly of the assembled device according to FIG. 9 perpendicular to the rotational axis YY', the container being in the closed position, and locked.

In the example illustrated in FIGS. 9A, 9B and 16, the container is formed by a substantially parallelepiped casing 14 which is open in its upper part. The casing 14 comprises a substantially rectangular base bordered by two lateral faces, a front face and a rear face. This container is intended to receive a key 1.

The casing 14 comprises, moreover, on the side of its rear face a tubular cylindrical section 14C with the axis YY' provided with two diametrically opposing notches 14B (symmetrical relative to the longitudinal plane of symmetry of the casing), perpendicular thereto. These notches 14B permit the housing of the longer front end part of the key 1.

The casing 14 is closed by a cover 13 pivotably mounted coaxially about the axis YY' of the tubular section 14C. This cover, of substantially identical shape to that of the base, has in its rear part a circular orifice 13C extended to the inside of the casing 14 by a cylindrical sleeve 13D of external diameter substantially equal to the internal diameter of the tubular section 14C but at a height less than said tubular section.

This cylindrical sleeve 13D comprises a base 13F provided with two diametrically opposed slots 13FD and 13FG. These slots 13FD and 13FG respectively comprise an external circular part 13FG1 and 13FD1, two internal circular parts 13FG2, 13FD2 and 13FG5, 13FD5 and a planar part 13FG3 and 13FD3 located closer to the axis YY' and forming a notch. This base comprises a centering stud TC permitting the centering and the positioning of an elastic element 15.

The fixing of the cover to the casing 14 in this assembled position is ensured due to a button 16 having a cylindrical head of external diameter substantially equal to the internal diameter of the cylindrical sleeve 13D of the cover in which it is engaged. The skirt of this button is extended by two diametrically opposed elastic axial tabs 16D and 16G arranged so as to pass through the slots 13FD and 13FG of the base 13F of the cover 13.

The lower ends of each of these tabs 16D, 16G are provided with an internal protuberance 16FG3, 16FD3 forming successively a recess 16DE and a chamfer 16CH.

This internal protuberance 16FG3, 16FD3 is intended to be clipped (in particular due to the chamfer) under a circular edge provided on the internal surface of the tubular section 13C to ensure both the holding of the button 16 on the casing 14 and indirectly of the cover 13 on the casing 14. A housing 14A in the casing 14 permits the pushing-in of the button 16 but prevents the rotation of the button 16. The internal protuberance when the button is in the pushed-out position, prevents the rotation of the cover 13. In contrast, when the button is pushed in, the internal protuberance is released and passes under the base of the cylindrical sleeve 13D and thus permits the release of the cover 13 which is thus free to rotate. In this case an angle of rotation in the order of 50° is possible.

The elastic element 15 is arranged between the upper face of the push button and the base so as to ensure an elastic clamping of the housing/cover/push button assembly.

In this assembly, the holding of the cover 13 in the perfectly closed position is ensured as the cover 13 interlocks into the casing 14 under the effect of the elastic action of the spring. This interlocking relates, in this case, to the precise relative positioning of the cover on the casing when the container is closed. This is obtained in this example by a chamfer CH located all around the extent of contact between the casing and the cover.

The mounting of the assembly and its use are relatively simple. More specifically, this structure makes it possible with a relatively low number of parts to implement a plurality of functions and thus to reduce the cost of implementation and mounting.

To mount the container, it suffices to place the cover 13 on the casing 14 and to position the spring 15 and the button 16 and to push in the button to clip it onto the casing.

To use the container which is initially empty and in the closed and locked position it suffices to press on the button. The translation of the button along the axis YY' compresses the spring 15 and drives the protuberance of the button below the base of the cover 13 and permits the rotation of the cover 13. It is possible to open the container by rotating the cover 13 about the axis YY'. It is thus possible to place the key in the container, then to close the cover 13 by rotating said cover in the opposite direction. When the cover 13 comes into the closed position the protuberance of the button is positioned opposite the notches 13FG3 and 13FD3 and thus allows the button to be lifted up under the action of the spring and thus locks the assembly. To remove the key it suffices to repeat the operations by removing the key instead of placing it in the container.

Figure 10:
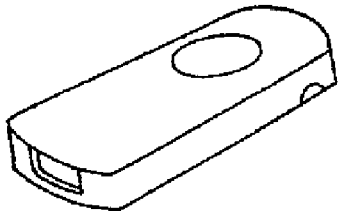
FIGS. 10 to 15 show schematically the sequences for positioning and removing a key from the container according to the preferred solution of FIG. 9.
Figure 11:
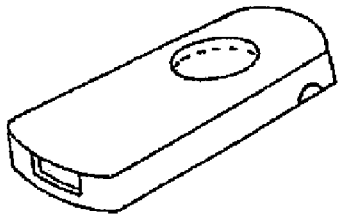
Figure 12:
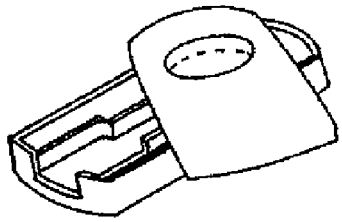
Figure 13:
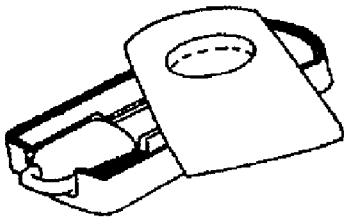
Figure 14:
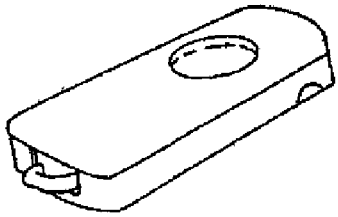
Figure 15:
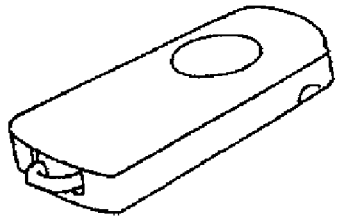

In the example shown in FIGS. 9 and 16, the steps of the process of positioning the key in the container and removing the key from the container are presented in the series of FIGS. 10 to 15. FIG. 10 shows the empty container and the mobile part in the closed and locked position. FIG. 11 shows the empty container and the mobile part in the closed and unlocked position; the push button is in this case pushed in. FIG. 12 shows the empty container and the mobile part in the open position. FIG. 13 shows the key in position in the container, the mobile part being in the open position. FIG. 14 shows the container containing the key and the mobile part in the closed and unlocked position. FIG. 15 shows the container containing the key and the mobile part in the closed and locked position.

Further technical solutions and variants may be easily conceived from this structural design. More specifically, it is possible for example to clip the cover 13 directly onto the casing 14 and to design a button which would only be used to lock or unlock the cover 13. It is also possible to design a structure of the assembly where one or more locking tabs might be fixed relative to the cover 13.

It is also possible to prestress the compression spring in torsion so that this spring operates in compression and in torsion so that when the button is pushed in, the spring has the tendency to open the cover.

The compression spring may also be replaced by any elastic element having the same functions as said spring.

The container or the unlocking control button 16 may comprise on its visible face a surface for carrying information such as a logo for example.

The device according to the invention is well suited for ensuring predetermined positioning and improving the protection of an emergency key in a container. This device according to the invention is, therefore, not limited to the examples cited above, but may be modified within the scope of the claims without changing the scope thereof.

The invention claimed is:

1. A container for an emergency key comprising at least a cover and a casing, wherein:

opening/closing means consisting of the cover pivotably mounted about a rotational axis on the casing, allow the cover and the casing to be mobile in relation to one another, at least in rotation, about the rotational axis, between an open position providing access to a housing of the container configured to position and hold the emergency key, and a closed position, wherein means for locking/unlocking the cover and the casing at least in a closed position, comprise a locking/unlocking control member which is mobile in translation along a translation axis, and wherein the rotational axis is perpendicular to a top surface of the cover and a bottom surface of the casing, wherein the locking/unlocking means comprise a button slidably mounted in a cavity of the cover between a pushed-in position and a raised position, wherein the button is configured to actuate additional locking means which act on the rotatable mounting of the cover on a body of the casing so as to prevent the rotation of the cover in the raised position and to allow rotation of the cover in the pushed-in position, wherein the locking/unlocking means comprise an elastic element tending to bring the button back into a locked position, and wherein the casing comprises, on the side of a rear face, a tubular cylindrical section, the cover having a circular orifice extended to the inside of the casing by a cylindrical sleeve, provided with a base, having two opposing circular slots, said cylindrical sleeve engaging in the tubular cylindrical section, wherein the button is engaged in the cylindrical sleeve and comprises two elastic axial tabs passing through said circular slots, and each elastic axial tab having an internal protuberance.

2. The container as claimed in claim 1, wherein the elastic element is a spring operating in compression.

3. The container as claimed in claim 1, wherein the circular slots each comprise a notch in which a protuberance provided on each elastic axial tab engages when the button is in the raised position.

4. The container as claimed in claim 1, wherein an elastic means tends to open the cover automatically as soon as the button is pushed in.

5. The container as claimed in claim 4, wherein the elastic means tending to open the cover automatically is a torsion spring.

6. The container as claimed in claim 5, wherein the torsion spring is combined with a compression spring in a single compression and torsion spring.

7. The container as claimed in claim 1, wherein the container comprises an opening allowing the passage of a bow of the key.

8. The container as claimed in claim 1, wherein the container comprises, on a visible part, a surface for carrying a logo.

9. The container as claimed in claim 1, wherein an information carrier is placed on the locking/unlocking control member which is mobile in translation.

* * * * *